US010004933B2

(12) United States Patent
Lennox et al.

(10) Patent No.: US 10,004,933 B2
(45) Date of Patent: Jun. 26, 2018

(54) ROTARY EXERCISE SYSTEM

(71) Applicant: Maxx Bench, Wilkes Barre, PA (US)

(72) Inventors: James J. Lennox, Shickshinny, PA (US); David Vorozilchak, Shavertown, PA (US); Philip Matthew Hunt, Kintnersville, PA (US)

(73) Assignee: Maxx Bench

( * ) Notice: Subject to any disclaimer, the term of this patent is extended or adjusted under 35 U.S.C. 154(b) by 0 days. days.

(21) Appl. No.: 15/666,919

(22) Filed: Aug. 2, 2017

(65) Prior Publication Data

US 2018/0036573 A1 Feb. 8, 2018

Related U.S. Application Data

(60) Provisional application No. 62/369,793, filed on Aug. 2, 2016.

(51) Int. Cl.
*A63B 21/015* (2006.01)
*A63B 21/00* (2006.01)
(Continued)

(52) U.S. Cl.
CPC ..... *A63B 21/00072* (2013.01); *A63B 1/00* (2013.01); *A63B 21/00192* (2013.01);
(Continued)

(58) Field of Classification Search
CPC ..... A63B 1/00; A63B 21/00072; A63B 21/00192; A63B 21/012; A63B 21/068;
(Continued)

(56) References Cited

U.S. PATENT DOCUMENTS 3,874,657 A 4/1975 Niebojewski
4,355,633 A * 10/1982 Heilbrun ..... A61H 1/0214 482/903

(Continued)

OTHER PUBLICATIONS

Mtp://www.platinumrig.ca/en/shop/course-a-abstacles-en/infinit-monkey-bar/?lang=en?la., Infinite Monkey Bars, searched for on Nov. 13, 2017. CA.

(Continued)

*Primary Examiner* — Joshua Lee
(74) *Attorney, Agent, or Firm* — The Belles Group, P.C.

(57) ABSTRACT

A rotary exercise system in one embodiment includes a chassis configured for mounting to stationary support members, a rotational support shaft rotatably coupled to chassis, and handle bar assembly coupled to the support shaft and manually rotatable therewith by a user. A variable resistance mechanism applies a user-adjustable rotational resistance force on the support shaft, which changes the force required to be applied by the user to rotate the handle bar assembly during an exercise routine. In some embodiments, the resistance mechanism may be a frictional resistance mechanism, such as a drum or disc brake assembly. A user-operated control actuator allows the user to readily change resistance settings to increase or decrease the rotational resistance imparted to the support shaft by the resistance mechanism. In some implementations, the chassis may be detachably mounted on vertical supports of a power rack and adjustable in height for performing different exercise routines.

22 Claims, 12 Drawing Sheets

(51) Int. Cl.

| | |
|---|---|
| ***A63B 1/00*** | (2006.01) |
| ***A63B 21/012*** | (2006.01) |
| ***A63B 21/068*** | (2006.01) |
| ***A63B 23/12*** | (2006.01) |
| ***A63B 21/22*** | (2006.01) |

(52) U.S. Cl.
CPC ..... *A63B 21/012* (2013.01); *A63B 21/068* (2013.01); *A63B 21/22* (2013.01); *A63B 21/4035* (2015.10); *A63B 21/4049* (2015.10); *A63B 23/1218* (2013.01); *A63B 2225/093* (2013.01)

(58) Field of Classification Search
CPC . A63B 21/22; A63B 21/4035; A63B 21/4049; A63B 23/1218; A63B 2225/093
See application file for complete search history.

(56) References Cited

U.S. PATENT DOCUMENTS 4,848,737 A * 7/1989 Ehrenfield ..... A63B 21/157 482/37
4,902,002 A * 2/1990 Huang ..... A63B 22/0012 482/62
5,145,472 A * 9/1992 Johnson, III ..... A63B 23/12 482/119
9,126,069 B2 * 9/2015 Ochi ..... A63B 4/00
2002/0091041 A1 * 7/2002 Mantooth ..... A63B 17/00 482/35
2005/0096197 A1 5/2005 Webber et al.
2009/0156377 A1 * 6/2009 Brown ..... A63B 23/12 482/110
2013/0296143 A1 * 11/2013 Staten ..... A63B 21/0618 482/98
2014/0213414 A1 * 7/2014 Balandis ..... A63B 24/0087 482/5
2015/0182773 A1 7/2015 Olson et al.
2018/0021614 A1 * 1/2018 Taft ..... A63B 21/169

OTHER PUBLICATIONS

International Search Report and Written Opinion for Corresponding PCT/US2017/045023 dated Oct. 23, 2017. WO.
Corresponding International Search Report and Written Opinion for PCT/US2017/045023 dated Oct. 23, 2017.

* cited by examiner

ROTARY EXERCISE SYSTEM

CROSS-REFERENCE TO RELATED APPLICATIONS

The present application claims the benefit of priority to U.S. Provisional Application No. 62/369,793 filed Aug. 2, 2016, which is incorporated herein by reference in its entirety.

BACKGROUND

The present invention relates to a rotary exercise system with adjustable rotational resistance to improve training for climbing, pull-ups, CrossFit, general upper body strength, and other forms of fitness.

Traditional means of climbing exercise equipment consume large amounts of space and are potentially dangerous. Elevated monkey bars often seen in CrossFit games, attached to rigs and racks, and included in current multi-functional fitness setups designed for multiple users are designed to elevate users sometimes as high as 12 ft. in the air. Fatigue and muscle failure while climbing these pieces of equipment could prove to be extremely dangerous. Other prior approaches of overhead exercise equipment to simulate continuous climbing or pull-ups include complex designs with many parts, often requiring electricity and motors. Several of the designs utilize a conveyor belt like system with handle bars. Still others may have free spinning handles or bars providing minimal strength training. The foregoing devices further lack versatility for working different muscle groups and performing different exercise routines.

A need exists for an improved and versatile rotary exercise system.

SUMMARY

A rotary exercise system with user-adjustable rotational resistance is described in this application that allows for the same foregoing climbing exercises and motions to be performed in a small space and at a controlled height. The exercise system generally comprises a bi-directionally rotating handle bar assembly rotatably coupled to a support chassis. A resistance mechanism applies a user selectable and adjustable rotational resistance to the handle bar assembly, making it more or less difficult for the user to rotate the handle bars as desired. The handle bar assembly may be mounted at a variety of heights from near the floor and upwards to provide different exercise routines for working various muscle groups including the arms, chest, and legs. None of the prior approaches include a handle bar assembly rotating on a single axis of rotation with adjustable rotational resistance in which the mechanism is directly powered manually by the user.

The rotary exercise system may be used in a variety of mounting positions and heights to permit the user to perform different exercise routines. When the user is suspended freely from the handlebars as in a traditional pull-up exercise, the downward force of gravity of the user's body weight generates a moment about the axis of rotation and thus rotation of the system. When a user is firmly planted on the ground, either sitting or reclining, the force exerted by the user's muscles generates rotation of the rotary apparatus.

The rotating exercise apparatus allows a user to simulate continuous upward climbing while staying in a controlled location, at a controlled height. It creates a unique, space saving climbing experience, a safer environment, an effective work out, and gives users a greater sense of accomplishment and enjoyment compared to standard pull-up bars, inclined monkey bars, rock climbing walls, and free-climbing.

The adjustable rotational resistance control disclosed herein allows the user to regulate the rate of rotation to accommodate users of different body weight and that desired for different exercises. For instance, a larger user with a higher body weight will generate a greater force against the resistance mechanism. By increasing the rotational resistance, the rate of rotation will remain controlled during use. Greater resistance is also beneficial for explosive exercises such as two handed jump pull-ups from bar to bar. By decreasing the rotational resistance, the apparatus accommodates smaller users with lower body weight and higher speed exercises. With different accessories attached to the bars, the rotating resistance climber can provide varied handholds thus giving a comprehensive forearm and grip workout. These handhold accessories can include but are not limited to: ropes, towels, ball grips, rock-climbing hand holds, wooden dowels of varying thicknesses, etc.

With adjustable height and resistance, the rotating resistance system can provide a superior workout for any fitness level. It is usable for elite athletes who can hold their whole body weight and continually climb. It is also usable with less resistance while users stand on the ground and need to work up to full pull-ups with their whole body weight suspending in air while hanging from the handle bars.

In one aspect, a rotary exercise system includes: a chassis configured for mounting between a pair of stationary elongated support members; an elongated rotational support shaft rotatably supported by the chassis, the support shaft rotatable in opposing directions about an axis of rotation; a plurality of handle bars coupled to the support shaft and rotatable therewith, the handle bars arranged to encircle the support shaft and be graspable by a user; a variable resistance mechanism operably coupled to the support shaft, the resistance mechanism configured and operable to apply a selectable rotational resistance on the support shaft which is adjustable by the user; wherein adjusting the resistance mechanism increases or decreases a physical force required to be exerted manually by a user on the handle bars in order to rotate the support shaft.

In another aspect, a rotary exercise system includes: a pair of spaced apart vertical support members; a chassis comprising first and second mounting rack assemblies, each mounting rack assembly configured for detachable mounting to one of the vertical support members in a plurality of positions; an elongated rotational support shaft rotatably supported by the first and second mounting rack assemblies, the support shaft rotatable in opposing directions about an axis of rotation; a handle bar assembly comprising a plurality of elongated handle bars extending between a pair of side support structures rigidly coupled to the support shaft for rotation therewith, the handle bars arranged for grasping by a user and circumferentially spaced apart around the support shaft; a variable frictional resistance mechanism operably coupled to the support shaft, the resistance mechanism configured and operable to apply a selectable rotational resistance on the support shaft which is adjustable by the user; wherein adjusting the resistance mechanism increases or decreases a physical force required to be exerted manually by a user on the handle bars in order to rotate the support shaft.

In another aspect, a rotary exercise system includes: a pair of spaced apart vertical support members; a chassis comprising first and second mounting rack assemblies, each mounting rack assembly configured for detachable mounting to one of the vertical support members in a plurality of positions; an elongated rotational support shaft rotatably supported by the first and second mounting rack assemblies, the support shaft rotatable in opposing directions about an axis of rotation; a handle bar assembly comprising a plurality of elongated handle bars extending between a pair of side support structures rigidly coupled to the support shaft for rotation therewith, the handle bars arranged for grasping by a user and circumferentially spaced apart around the support shaft; a frictional resistance mechanism supported by one of the first or second mounting rack assemblies and operably coupled to the support shaft, the resistance mechanism configured and operable to apply a selectable rotational resistance on the support shaft which is adjustable by the user; a user-operated control actuator operably coupled to the frictional resistance mechanism, the control actuator having a plurality of user selectable resistance settings; wherein adjusting the control actuator to select one of the resistance settings increases or decreases a physical force required to be exerted manually by the user on the handle bars in order to rotate the support shaft.

BRIEF DESCRIPTION OF THE DRAWINGS

The features of the preferred embodiments will be described with reference to the following drawings where like elements are labeled similarly, and in which.

All drawings are schematic and not necessarily to scale. A reference herein to a figure number herein that may include multiple figures of the same number with different alphabetic suffixes shall be construed as a general reference to all those figures unless specifically noted otherwise.

DETAILED DESCRIPTION

Figure 1:
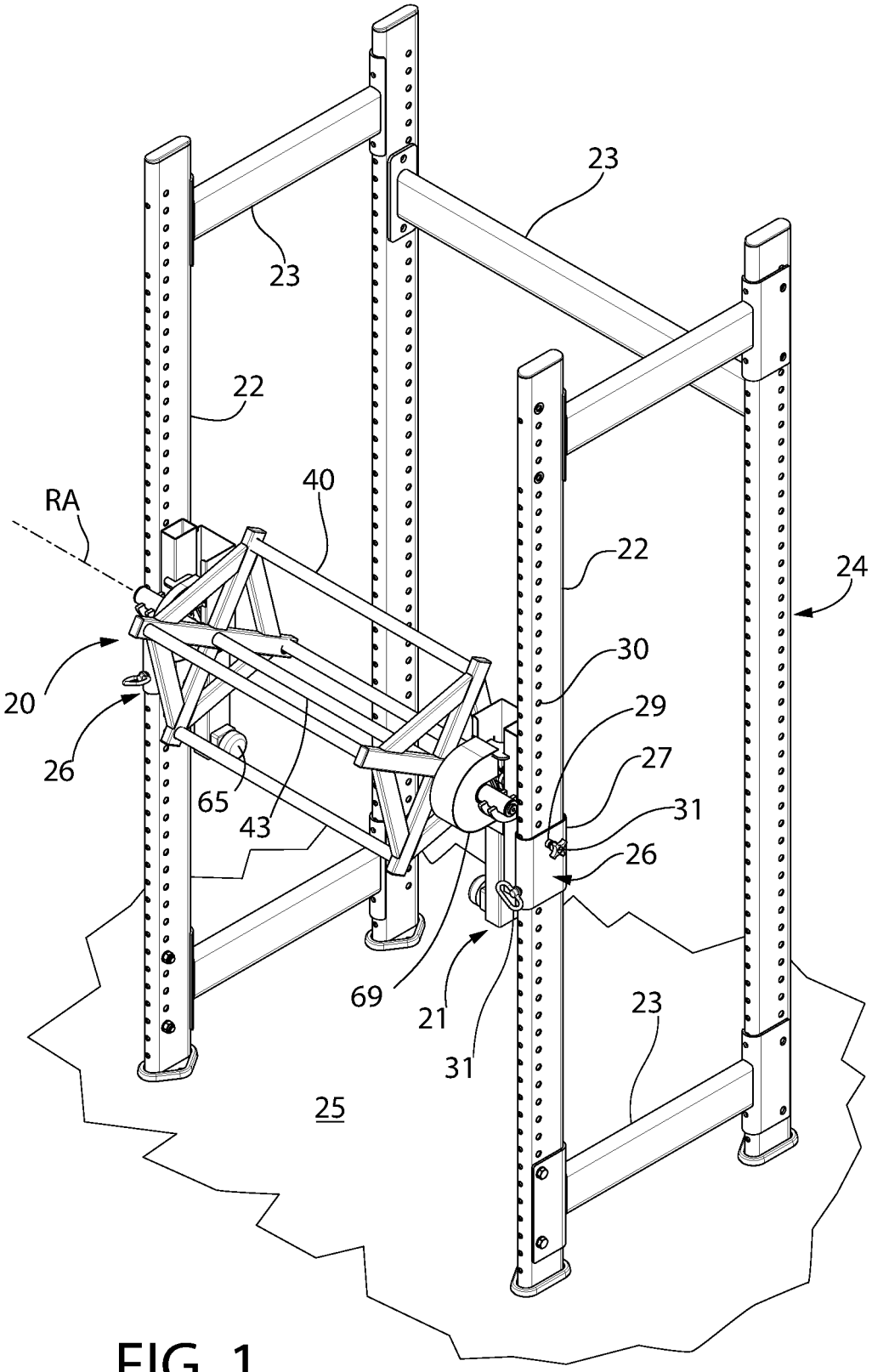
FIG. 1 is a perspective view of a rotary exercise system according to the present disclosure including a rotatable handle bar assembly and floor-supported exercise rack for mounting the handle bar assembly thereon.
Figure 3:
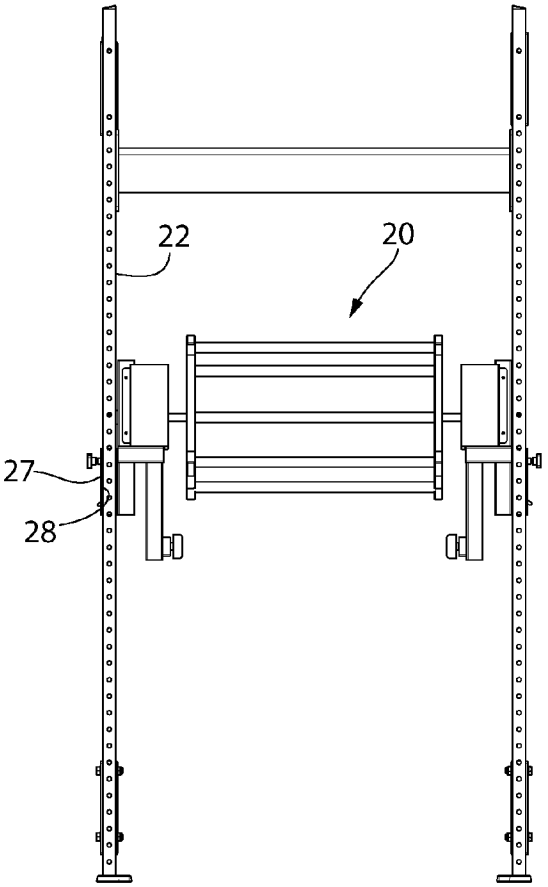
FIG. 3 is a rear elevation view thereof.
Figure 2:
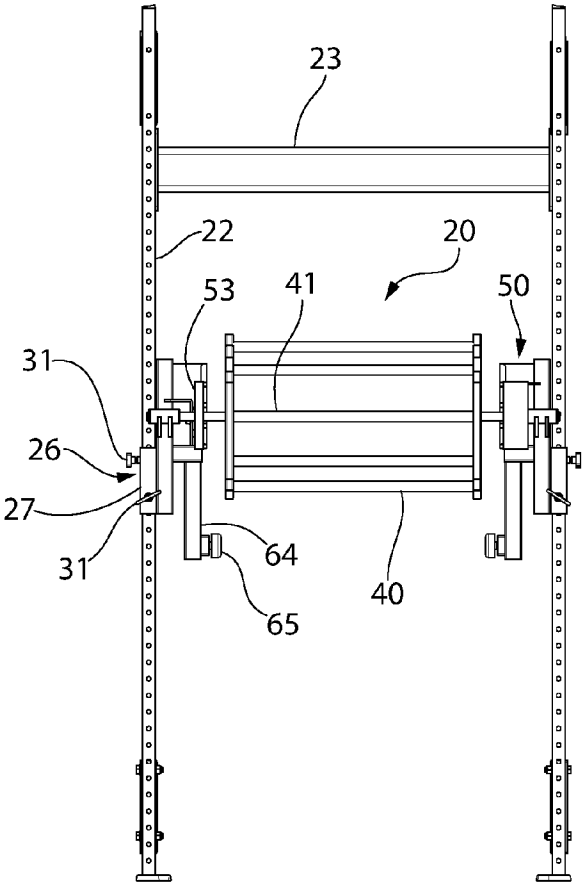
FIG. 2 is a front elevation view thereof.
Figure 4:
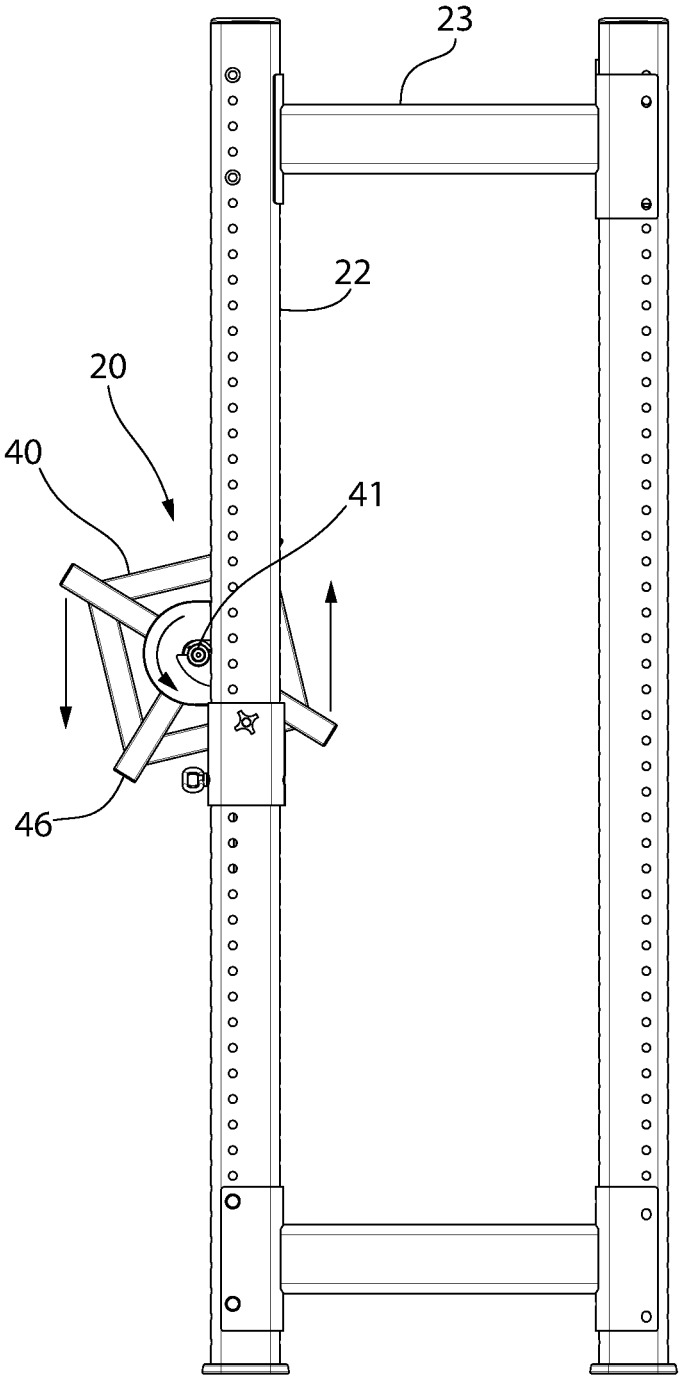
FIG. 4 is a side elevation view thereof.
Figure 5:
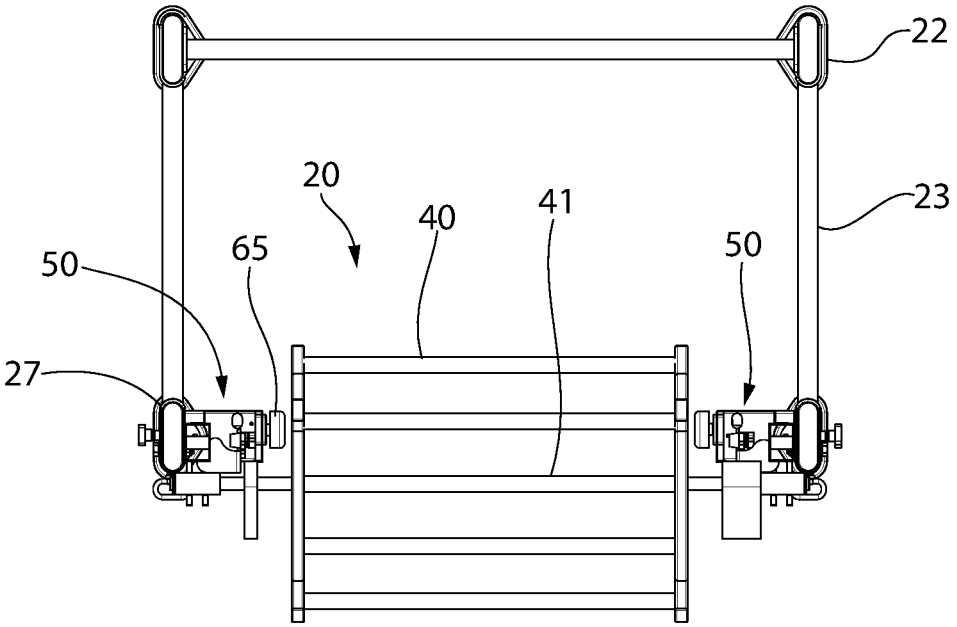
FIG. 5 is a top plan view thereof.
Figure 6:
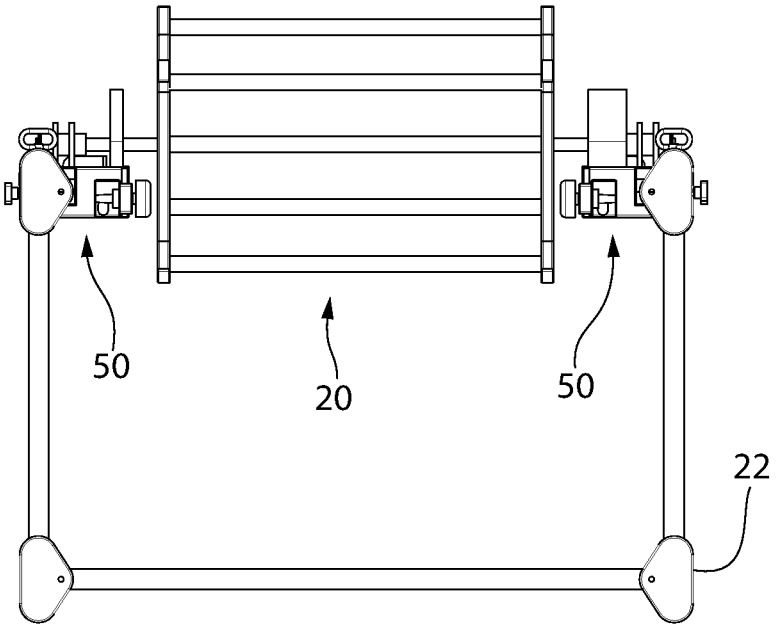
FIG. 6 is a bottom plan view thereof.

The features and benefits of the invention are illustrated and described herein by reference to exemplary embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

As used throughout, any ranges disclosed herein are used as shorthand for describing each and every value that is within the range. Any value within the range can be selected as the terminus of the range.

Referring initially to FIGS. 1-6, a rotary exercise system generally comprises a rotary apparatus in the form of handle bar assembly 20 rotatably mounted to a chassis 21 configured for detachable mounting to and between at least two vertical uprights or supports 22 of a stationary support frame or structure. In one non-limiting embodiment, the support structure may be a free-standing power rack 24 as shown comprising fours vertically elongated support members 22 and a plurality of horizontal cross members 23 spanning between the support members to form a rigid space frame. The bottom ends of the support members 22 are configured for engaging a generally flat floor support surface 25 of any suitable type and construction. Support members 22 and cross members 23 are metal structural elements (e.g. steel, aluminum, and/or titanium) which may be solid or have an open tubular construction for weight reduction. Cross members 23 may be permanently attached to the vertical support members 22 or removable attached thereto such as via fasteners as shown.

In one non-limiting embodiment, the chassis 21 may comprise a first (e.g. right) and second (e.g. left) mounting rack assembly 26. The mounting rack assemblies 26 may be specifically configured for detachable securement to the vertical supports 22 of the power rack 24 or alternatively the vertical supports of another type support structure. In one embodiment, each mounting assembly 26 comprises a mounting bracket 27 complementary configured and dimensioned to the transverse cross-sectional shape and size of the vertical supports 22. Brackets 27 may be three-sided collar in one embodiment comprising an open rear, opposing front wall, and two adjoining sidewalls extending perpendicularly rearward from the front wall. Brackets 27 further define a cavity 28 therein for receiving and securing the vertical support 22. Each bracket 27 may be attached to a vertical support 22 by horizontally inserting the support into cavity 28 of the bracket. When the vertical supports 22 are inserted into the cavities 28, the brackets 27 are vertically slideable along the vertical supports of the rack 24 to a user-selectable desired mounting position or height of the handle bar assembly 20. Each bracket includes one or more mounting holes 29 which are concentrically alignable with corresponding mounting holes 30 formed the vertical supports 22 of the power rack 24. Removable fasteners 31 such as without limitation bolts or pins are provided for insertion through each pairs of aligned holes 29, 30 for securing and fixing the bracket in position on the power rack. Pins if used for fasteners 31 may be any type or configuration compatible for use with the holes of the power rack vertical supports 22.

It bears noting that the three-sided mounting bracket 27 allows the chassis 21 to be mounted to the power rack 24 without partially disassembling the rack. In other possible embodiments, however, the centrally open brackets 27 may be have a completely enclosed tubular cross-sectional shape thereby forming an annular collar with four opposing perpendicular walls (see, e.g. FIG. 7) that completely encircles the power rack vertical support 22 when inserted through the cavity 28 of the bracket. This latter design is mounted by vertically sliding the bracket onto the top end of the rack vertical support 22 and sliding the bracket downward to the desired mounting position. Of course, other configurations of mounting brackets 27 may be used in other embodiments beyond the foregoing non-limiting examples so long as the chassis may be fixedly attached to the rack vertical supports 22. In yet other possible implementations, the mounting brackets 27 may be non-removably and permanently attached to other types of dedicated support structures with vertical supports such as via welding.

Figure 10:
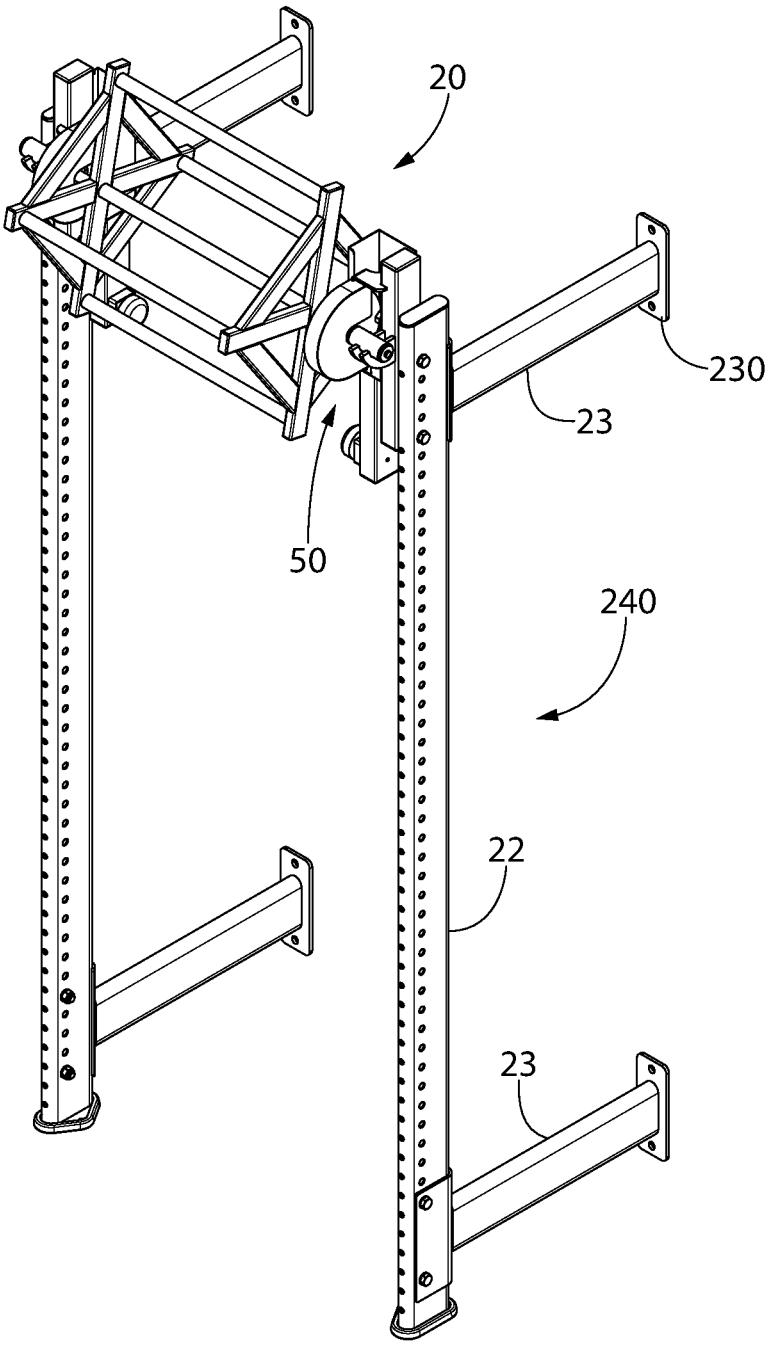
FIG. 10 is a perspective view of an alternative embodiment of a floor and wall-mounted exercise rack with handle bar assembly mounted thereon.
Figure 11:
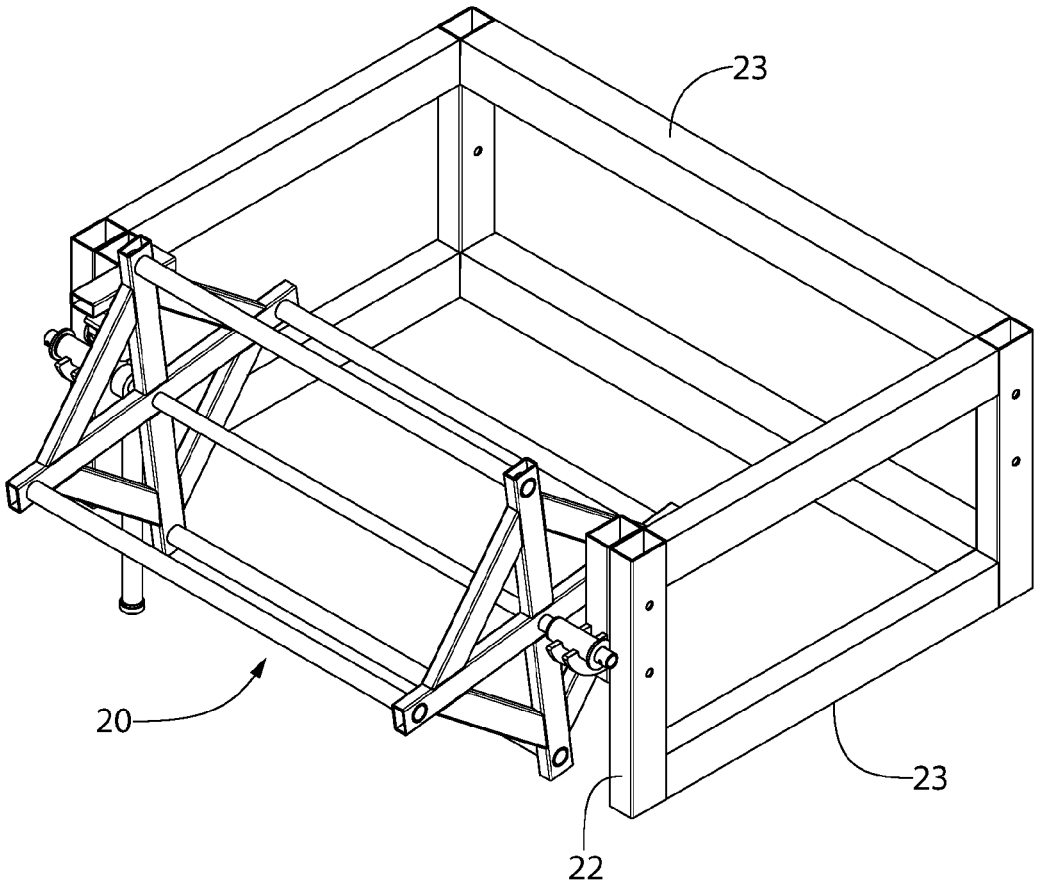
FIG. 11 is a perspective view of another alternative embodiment of a wall-mounted exercise rack with handle bar assembly mounted thereon.

It will be appreciated that the rotary exercise system is not limited in its applicability to free standing power racks alone, which represented only one of many possible mounting options. In other possible embodiments, the chassis 21 of the exercise system may be attached to a wall mounted power rack 240 as shown in FIG. 10. This rack comprises two vertical support members 22 configured to rest on a support surface. These support members 22 are each anchored near both the top and bottom ends to a wall structure by horizontal supports 23. The horizontal supports 23 are configured for mounting to the wall structure, and may include end flanges 230 with holes to receive fasteners as depicted or other appurtenances to facilitate anchoring to the wall structure. In yet other possible embodiments, entirely wall mounted vertical members 22 may be provided as shown in FIG. 11 which do not extend to the floor. Such a construction comprises a box frame with shortened height comprising four vertical support members 22 and horizontal supports 23 extending therebetween as shown. The rear vertical members 22 are attached to a wall structure and the front two verticals are used for mounting the rotary exercise system. This mounting rack is dedicated solely to the rotary exercise machine and may be a self supporting unit including the mounting rack and rotary handle bar unit and all appurtenances described further herein. Accordingly, it will be clear to those in the art that numerous mounting variations of the rotary exercise system are possible and does not limit the invention.

The present rotary exercise system is further not limited to mounting on vertical supports of "power racks" or portions thereof. Instead, the system only requires two rigid and stationary members of any orientation for mounting and is thus not limited in its applicability by the construction of the structure that supports stationary members. For example, although the figures depict horizontal mounting of the exercise system on a pair of vertical supports (i.e. handle bars extending horizontally), it will be appreciated that the exercise system may be used in a vertical orientation with the handle bars extending vertically instead. In this case, the main support members 22 may instead be oriented horizontally for securing the chassis 21 thereto. Such an orientation would allow other types of exercise motions to be performed by the user (e.g. pulling on the handle bars with one arm and pushing the handle bars with the other arm).

The structure of the handle bar assembly 20 will now be described. Referring to FIGS. 1-7, the rotary handle bar assembly 20 includes a central or main rotational support shaft 41 and plurality of handle bars 40 coupled to the support shaft and rotatable therewith. Support shaft 41 defines an axis or rotation RA of the handle bar assembly. In one embodiment, support shaft 41 and handle bars 40 may each have an elongated cylindrical shape which may have a textured or knurled surface to facilitate gripping by the user. In other embodiments, handle bars 40 may have different shapes or be other entirely different type elements such as without limitation ball grips, rock climbing handles or grips, towels, pegs, ropes, etc.

Handle bars 40 may be coupled to support shaft 41 by a support frame comprising a pair of side support structures 42 laterally spaced apart on the shaft. In one embodiment, each side support structure 42 may include an X-shaped lateral support member 43 rigidly attached to the support shaft 41 such as via welding to be rotatable in unison therewith. Other forms of rigid attachment such as bolting, etc. may be used. Each lateral support member 43 may comprise four radial arms 46 in one embodiment which intersect perpendicularly at the support shaft 41 and extend radially outward therefrom as illustrated. The lateral support members 43 may be located inboard on the rotational support shaft 41 such that an outboard end portion 48 of the main support shaft 41 extends laterally outwards for a distance beyond each support member 43 for rotational mounting to each side mounting rack assembly 26, as further described herein.

The lateral support members 43 may be constructed by casting or forging as a monolithic unitary structure with each radial arm 46 being an integral part thereof. In other embodiments, lateral support members 43 may be constructed from two or more structural elements welded together. In the non-limiting illustrated embodiment, the arms 46 may have a rectilinear cross-sectional shape such as rectangular or square (i.e. rectangle with even sides). Other shapes however may be used. The arms 46 may comprise hollow solid structure or tubular structures for weight reduction. Lateral angle braces 47 may be attached between each adjacent arm 46 as shown to add structural rigidity to the lateral support member 43. Braces 47 are obliquely angled to the radial arms 46.

Although each lateral support member 43 is depicted as an open frame polygonal structure in the illustrated embodiment to reduce weight, it will be appreciated that other configurations of these support members may be used. For example, in other embodiments lateral support members 43 may each be configured and formed as round disks fixedly attached to the main support shaft 41. Each disk may have a solid structure or a partially open structure with cutouts formed in the disk material to reduce weight. The handle bars 40 are attached at their ends to the disks. In some embodiments, the lateral support members 43 may each be configured as a spoked wheel having a central hub fixedly attached to the main support shaft 41, an outer circular and annular wheel to which the handle bars 40 are attached, and a plurality of spokes extending radially between the hub and wheel in a well-known manner. Accordingly, the lateral support members 43 are not limited to any particular configuration so long as the handle bars 40 may be rigidly supported from the main support shaft 41.

The side support structures 42, main rotational support shaft 41, handle bars 40, and mounting rack assemblies 26 are preferably formed of a suitably strong metal for their given application, such as steel, aluminum, titanium, or other. A combination of metals may be used for different parts and need not all be the same. The components may have a solid structure or comprise hollow tubular elements for weight reduction.

With continuing reference now to FIGS. 1-7, opposing ends 45 of each handle bar 40 are attached to one of the radial arms 46 of each X-shaped lateral support member 43. In one embodiment, the handle bars 40 may be attached proximate to the terminal free end of each arm 46 as shown. Handle bars 40 may be oriented parallel to the main support shaft 41. When constructed, the handle bars may be arranged to encircle the support shaft 41 as shown and are positioned to be readily graspable by a user. In operation, a user manually pulling or pushing on one of the handle bars 40 rotates the main rotational support shaft 41 vis-á-vis the side support structures 42. In one embodiment, the handle bars 30 may be rigidly attached to the lateral support members 46. In other embodiments, the handle bars 30 may be rotatably attached to the lateral support members 43 and may be freely rotatable in relation thereto.

In the illustrated embodiments, four handle bars 40 are provided based on the shape of the X-shaped lateral support members 43 each having four arms for mounting the handle bars. In other possible embodiments, other configurations of side support structures 42 may be provided having more or less number of arms; thereby changing the number of handle bars which may be used. For example, in some alternative embodiments the side support structures may each have six equal spaced arms instead of four thereby allowing six handle bars to be provided. Accordingly, the invention is not limited to any particular number of handle bars although preferably at least four are provided so that the user does not have to reach overly far to grab the next successive handle bar 40 as the handle bar assembly 20 rotates during the exercise routine.

Figure 7:
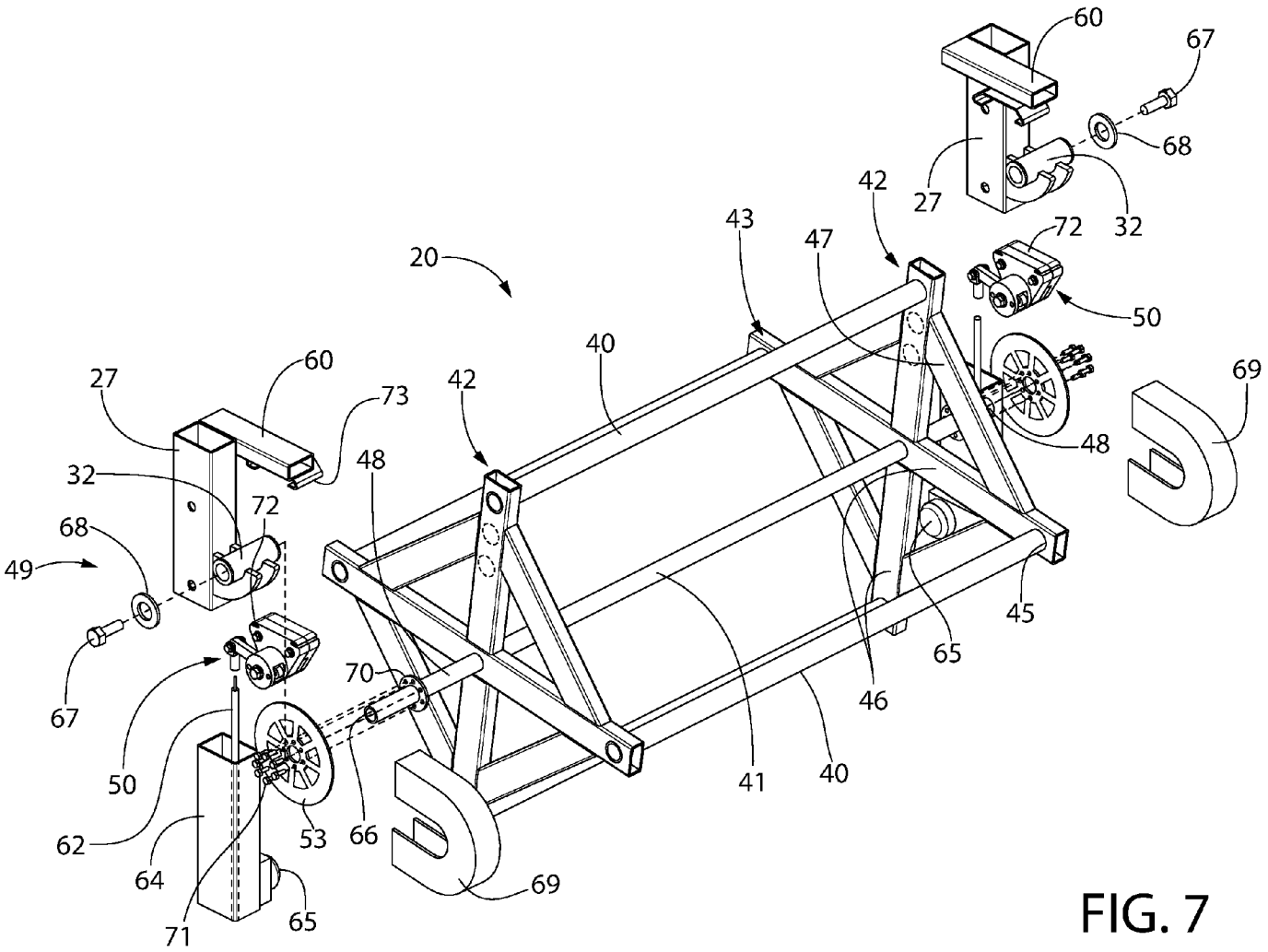
FIG. 7 is an exploded view of the handle bar assembly and its rack mounting structure.

Referring now to FIGS. 1-7, each mounting bracket 27 further includes a support bushing 32. Bushing 32 have a hollow tubular shape and receive the outboard free end portions of the main rotational support shaft 41 therein as shown. The bushings 32 are preferably formed of as suitably strong metal and are rigidly attached to the mounting brackets 27 by any suitable means, such as welding. The interior circumferential surfaces of the bushings 32 provide annular bearing surfaces which support both ends of the support shaft 41, and thus transmit the weight of handle bar assembly 20 and user (when hanging therefrom) to mounting rack assemblies 26 and in turn to the power rack vertical support members 22. The support shaft 41 of the handle bar assembly 20 is rotatable inside the bushings 32, thereby rotatably mounting the support shaft 41 to the chassis 21. In one embodiment, the opposing terminal end portions 48 of the support shaft 41 protrude outwards beyond the bushings 32. This allows a removable travel stop 49 or other retention device to be secured to each end portion 48 of the shaft for trapping the handle bar assembly 20 between the side mounting rack assemblies 26, thereby collectively forming a single unit that can be easily transported and mounted on the power rack vertical support members 22 by the user. In various embodiments, for example without limitation, the travel stops 49 may comprise an assembly of a bushing or washer 68 and fastener 67 threaded into an axial threaded bore 66 formed in the ends of the shaft 41 as shown in FIG. 7, an assembly of a washer and cotter pin extending through a through-bore formed transversely through the end portion of the shaft 41 (not shown), or any other suitable part or assembly of parts operable to prevent the support shaft from pulling through the two spatially separated bushings 32. It is well within the ambit of those skilled in the art to provide a suitable travel stop and shaft retention device.

The rotary exercise system further comprises at least one a user-adjustable rotational resistance assembly or mechanism 50 operably coupled to the main rotational support shaft 41. Resistance mechanism 50 is operable to apply a variable resistance on the support shaft 41 having a level of resistance which may be preselected by the user. The greater the resistance applied to the support shaft 41 by resistance mechanism 50, the harder it would be for the user to turn the handle bars 40, and vice-versa. Accordingly, the handle bar assembly 20 is not free spinning, thereby improving the exercise benefit in addition to allowing rotation of the handle bars 40 about the support shaft 41 in a controlled manner. Any suitable type of resistance device or mechanism may be used, including without limitation a frictional resistance mechanism, a magnetic resistance mechanism, a hydraulic fluid resistance mechanism, or a hydraulic or pneumatic cylinder resistance system.

In one embodiment, the frictional based resistance system may comprise a brake system such as a disc or drum brake mechanism. These type mechanisms are used in various types of bikes such as exercise and mountain bicycles, and other applications, and are well known in the art without undue elaboration.

Figure 8:
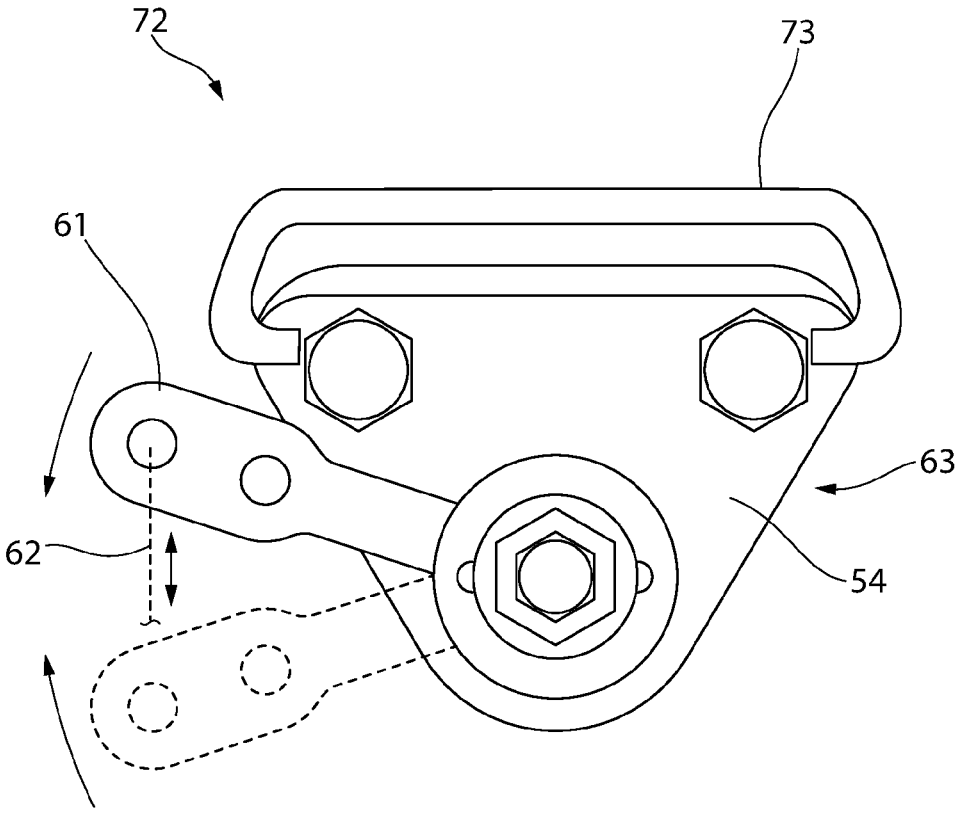
FIG. 8 is a side view of a frictional rotational resistance device in the form of a disc brake assembly.
Figure 9:
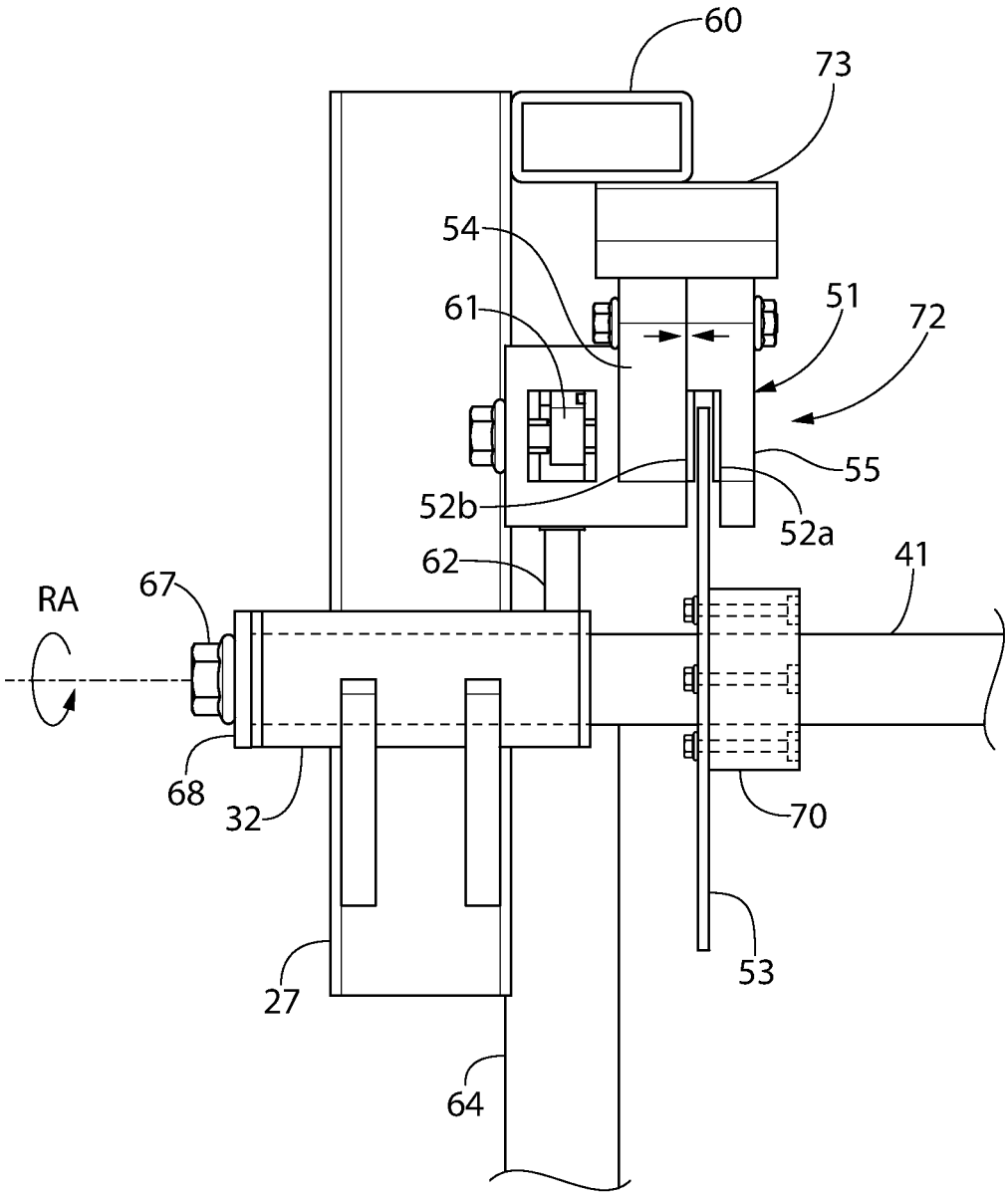
FIG. 9 is a front view thereof mounted on the handle bar rack mounting assembly.

One example of a frictional resistance mechanism 50 is shown in FIGS. 7-9. In this non-limiting embodiment, the resistance mechanism 50 may be a commercially-available disc brake unit 72 generally comprising an assembly of a rotor 53 fixedly but preferably not permanently attached to the main rotational support shaft 41 to rotate therewith and brake pad assembly. Rotor 53 is centered between a pair of disc brake pads 52*a*, 52*b* each supported by an adjustable caliper 51 in a well known manner. The spaced apart brake pads 52*a*, 52*b* are laterally and axially movable (parallel to the rotational axis RA of support shaft 41) toward or away from the rotor 53 to compress the rotor therebetween with varying degrees. This creates frictional resistance that impedes rotation of the main rotational support shaft 41 by the user when turning the handle bar assembly 20.

The rotor 53 may be fixedly attached to the support shaft 41 by numerous methods; one non-limiting example of which is shown and described herein. The rotor mount may include a bolted flange 70 permanently mounted on rotational support shaft 41 such as via welding. A plurality of fasteners 71 such as bolts or screws pass through holes in the flange 70 and corresponding holes in the central hub portion of the rotor disc for securing the rotor 53 to the flange in fixed manner. This arrangement allows the rotor to be readily replaced if necessary. Rotor 53 may be a relatively thin solid circular metal disc (disk), or alternatively may be a ventilated disc including cutouts such as variously shaped holes and slots (see, e.g. FIG. 7) to dissipate the heat of friction generated by the braking force and reduce weight. Ventilated rotors are commonly used for example in bicycle disc brake systems and other applications, and are well known in the art. Rotor 53 may be protected by removable covers 69 mounted to the mounting rack assemblies 26 (see, e.g. FIGS. 1 and 7).

A fixed or floating type caliper 51 may be used. In a fixed type caliper, the caliper remains stationary in axial position relative to the rotor 53. The brake pads are mounted to a pair of pistons on the caliper and each move axially inwards to clamp the rotor from each side.

Conversely, in the floating type caliper 51 shown and described herein, inner and outer portions of the segmented caliper body move relative to each other and the rotor. This type of caliper is typically less complex and expensive than a fixed type caliper. In the floating brake caliper 51 disclosed herein, the outer brake pad 52*b* is mounted on the outboard brake piston portion 54 of the segmented caliper body and inner brake pad 52*a* is mounted on the opposite inboard sliding caliper portion 55 of the body, respectively. Portions 54 and 55 are axially movable together and apart with respect to each other and the rotor 53.

In operation, the piston portion 54 of the caliper body pushes the outer brake pad 52*b* inwards when activated by a cam lever 54 operably coupled thereto until the pad engages the outward facing lateral braking surface of the rotor 53. The piston portion 54 thus cannot move any farther toward the rotor, which in turn causes the caliper to then pull the opposing sliding caliper portion 55 of the caliper body outwards towards the piston portion until inner brake pad 53 also engages the inward facing lateral braking surface of the rotor. This squeezes the rotor 53 between the brake pads, thereby creating frictional and rotational resistance to turning the handle bar assembly 20. The frictional braking force or pressure is applied to both sides of the rotor 53 in a direction parallel to the axis or rotation RA of the support shaft 41 and rotor 53. The distance between the brake pads 52*a*, 52*b* is therefore primarily controlled by the position of piston portion 54 of the caliper body, which in turn activates the opposing sliding caliper portion 55. Suitable floating caliper mechanical disc brake units that may be used in the present invention include MB1 Series units commercially available from Airheart Brake (Tolomatic Inc. of Hamel, Minn.) or other suppliers.

With continuing reference to FIGS. 7-9, the disc brake unit 72 may be mounted to and supported by one of the mounting rack assemblies 26. In one embodiment, the brake mount may include a first bracket 73 specially configured to engage or mounted the brake unit such as caliper body 63. Bracket 73 is in turn mounted to a second bracket 60 attached to the respective mounting rack assembly 26. The brake unit 72 may supported in a cantilevered manner as shown for positioning of the caliper 51 in proper relationship to the rotating rotor 53 and support shaft 41. Any materials and configurations of brackets may be used. It bears noting that although the brake unit 72 is shown mounted above the rotor 53 in the illustrated embodiment, any mounting position may be used including on the sides or beneath the rotor so long as the brake pads are engageable with the opposing side surfaces of the rotor.

According to one aspect of the invention, the frictional resistance mechanism 50 is user adjustable to allow the user to preselect and set a desired rotational resistance for the rotary exercise system. The disc brake caliper 51 may be operated and adjusted by a resistance control system, which may be either a mechanical or hydraulic mechanism; both of which are well known in the art. A mechanical resistance adjustment mechanism is shown herein as one non-limiting example. In one embodiment, a mechanical resistance adjustment mechanism may comprise cam lever 61 which is pivotably mounted on the caliper body 63. Lever 61 is connected to one top end of a control linkage such as metal wire control cable 62. The other bottom end of the cable is connected to a manual control actuator 65 which is coupled to and operable to push and pull the control cable 62, thereby transmitting a force to and pivoting the cam lever 61 in a known manner which adjusts the braking force or resistance. The control actuator 65 may be mounted to mounting rack assembly 26 by a mounting support 64 of any suitable configuration, such as a metal bracket.

Any suitable type of commercially available control actuator 65 may be coupled to the control cable 62, such as a rotary knob, pivotable lever, or other style user interface. A rotary control knob form of an actuator 65 is shown in the non-limiting illustrated example herein. Control cables and control actuators are commercially available from manufacturer's such as Glendinning Products, LLC of Conway, S.C. and others. Control actuator 65 has a plurality of user selectable resistance settings which changes the rotational resistance applied to the support shaft 41 of the handle bar assembly by the frictional resistance mechanism. Adjusting the control actuator to select one of the resistance settings increases or decreases a physical force required to be exerted manually by the user on the handle bars in order to rotate the handle bar assembly 20. Indicia may be included on the control actuator (e.g. knob or lever) to mark various rotational resistance settings, thereby providing repeatability of desired resistance settings by the user.

To adjust the rotational resistance applied to rotor 53 and in turn the handle bar assembly 20 by the disc brake system described above, the user rotates the resistance control knob (actuator 65) clockwise or counter-clockwise to the desired setting. The actuator 65 pushes or pulls the control cable 62 depending on the direction that the knob is rotated. The force transmitted by the cable 62 activates and pivots the cam lever 61 on the brake caliper 51, which either pushes the piston portion 54 towards further engagement with the rotor 53 or withdraws the piston portion therefrom thereby concomitantly moving the sliding caliper portion 55 of the caliper towards or away from the rotor, as described above. For example, when the control knob actuator is turned clockwise, the knob mechanism may pull the control cable 62 and cam lever 61 downward. An angled surface on the cam lever 61 pushes the brake piston portion 54 inwards towards the rotor 53 as the lever rotates. This correspondingly pulls the sliding caliper portion 55 of caliper 51 outwards towards the rotor, thereby pressing the both brake pads 52*a*, 52*b* against the rotor to increase friction, thus increasing rotational resistance in the system. Conversely, when the control knob actuator is turned counter-clockwise, the knob mechanism may push the control cable 62 and cam lever 61 upward instead. When the cam lever 61 pivots in this opposite direction, the angle on the cam lever allows the brake piston portion 54 to move outward and separate the brake pads 52*a*, 52*b* from the rotor 53 to decrease friction, thus decreasing rotational resistance in the system. The control actuator 65 therefore effectively changes the rotational resistance on the rotational support shaft 41 in a manner preselected by the user before the exercise routine begins.

In some embodiments, at least a single variable resistance mechanism such as the disc or drum brakes or other type resistance device described herein may be provided to apply rotational resistance to the rotational support shaft 41 of the handle bar assembly 20. In other embodiments as shown herein, a variable resistance mechanism may be coupled to each end of the support shaft 41 to impart a balanced resistance force to each side of the handle bar assembly 20.

A method of operation and use of the rotatable handle bar assembly 20 when the device is used as a pull-up bar will now be briefly explained. If the power rack 24 or 240 of FIG. 1 or 10 are used, respectively, the user may first select a desired mounting height/position of the handle bar assembly 20 on the vertical support members 22. Assuming the user wishes to perform pull-ups freely hanging from the handle bars 40 in this non-limiting example, the user positions the chassis 21 (i.e. mounting rack assemblies 26 along the vertical support members 22 at a height preferably so that the user will be freely suspended from the handle bars 40 when the lower-most handle bar is in a bottom vertical position as the handle bar assembly rotates. The user concentrically aligns the mounting holes 29 in each mounting rack assembly 26 with corresponding mounting holes 30 in the vertical support members 22, and then inserts a suitable fastener 31 therethrough. A lockable type fastener may be used to prevent inadvertent pullout of the fastener from the mounting holes. The rotary exercise system is now readied for use.

As the user jumps, grasps, and hangs from one of the handle bars 40 which is not directly underneath the rotational support shaft 41 (e.g. between the 12 and 6 o'clock positions), the user's bodyweight creates a downward force from gravity transmitted to the side support structures 42 to which the handle bars are attached. This in turn creates a torsional force acting on the rotational support shaft 41 which rotates with the rotor 53 mounted thereto about the axis of rotation RA. The torsion force acting around the axis of rotation RA causes the rotational support shaft 41 to rotate, thus rotating the handle bar assembly 20 and all of the handle bar members fixed to it. As the rotor 53 rotates, friction is created between the rotor and the brake pads 52*a*, 52*b*, and the rotational resistance continues along with the rotation until the user is no longer in a moment or torsion generating position (e.g. hanging directly underneath the axis of rotation). As the user climbs from one handle bar to the next higher one not directly beneath the support shaft 41, the torsional force will again be created and the fitness apparatus will continue to rotate as the user successively climbs from one handle bar to the next.

In engineering terms, the foregoing torsional force or torque (T) created by the user on the support shaft 41 (i.e. axis of rotation RA) is the product of the weight of the user (force F) and the distance (r) between the support shaft and the user (i.e. linear distance between the handle bar 40 and support shaft which is the moment arm). In this case, the moment arm (distance r) is represented by half the length of the radial arms 46 of the side support structures 42. Torque is expressed in units of foot-pounds or Newton-meters.

It bears noting that the angular speed that the handle bar assembly 20 will rotate is determined by the difference between the weight of the user and the frictional resistance preselected and set by the user for the frictional resistance mechanism 50. This allows the user to select the "climbing" speed from fast to slow. If the torsional force created by the user does not exceed the frictional resistance force selected by the user, the handle bar assembly 20 will not rotate at all. Accordingly, the frictional resistance setting used will vary with the weight of the user. Notably, the user may use the lowest-most handle bar 40 at the 6 o'clock bottom position for performing standing pull-ups. The torque neutral position will not cause the handle bar assembly 20 to rotated because there is no moment arm created by the force or weight of the user when hanging from this bottom handle bar.

It will be appreciated that the user may alternatively mount the handle bar assembly 40 at other positions on the vertical support members 22 (e.g. shoulder height, waist height, or below) to perform various types of exercises with the arms and legs. When mounted proximate to the exercise floor support surface 25, the user may lie on his/her back and rotate the device with the legs. Positions above this low mounting position may be used to perform various exercises with muscle groups other than the legs. Notably, the handle bar assembly 20 can advantageously be rotated in opposite directions with the same resistance force applied by the variable resistance mechanism 50. This expands the versatility of the rotary exercise system.

Figure 12:
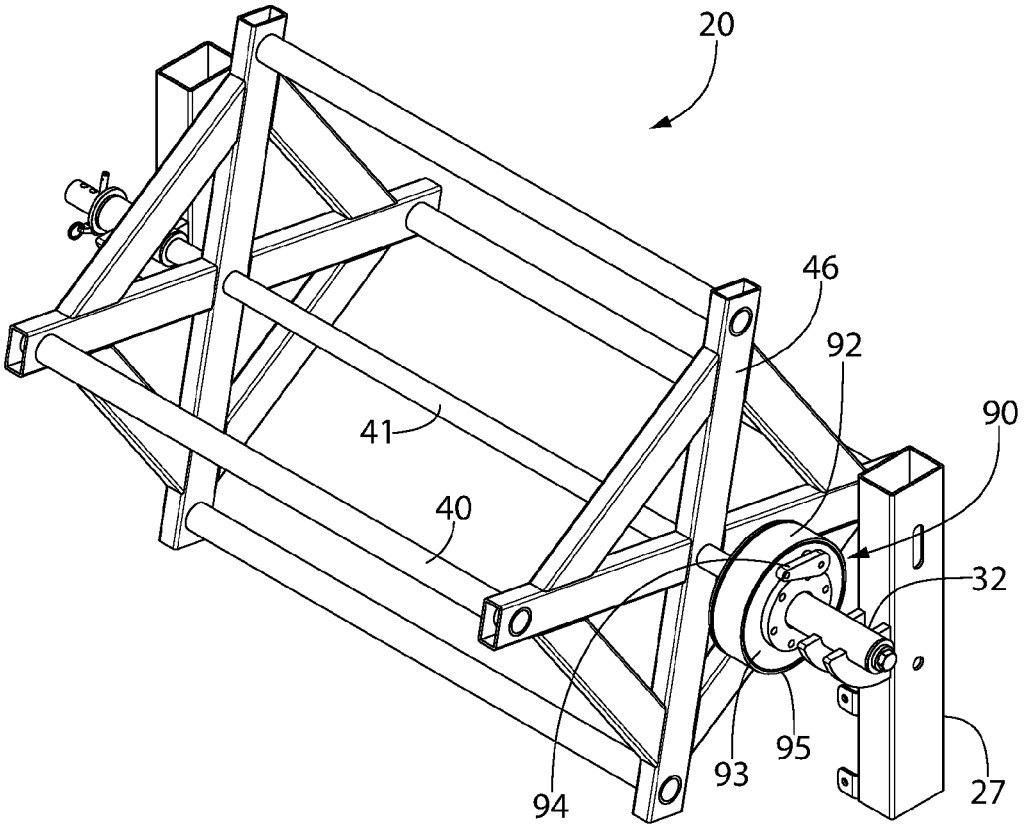
FIG. 12 is a perspective view of the handle bar assembly with an alternative frictional rotational resistance device in the form of a drum brake assembly.
Figure 13:
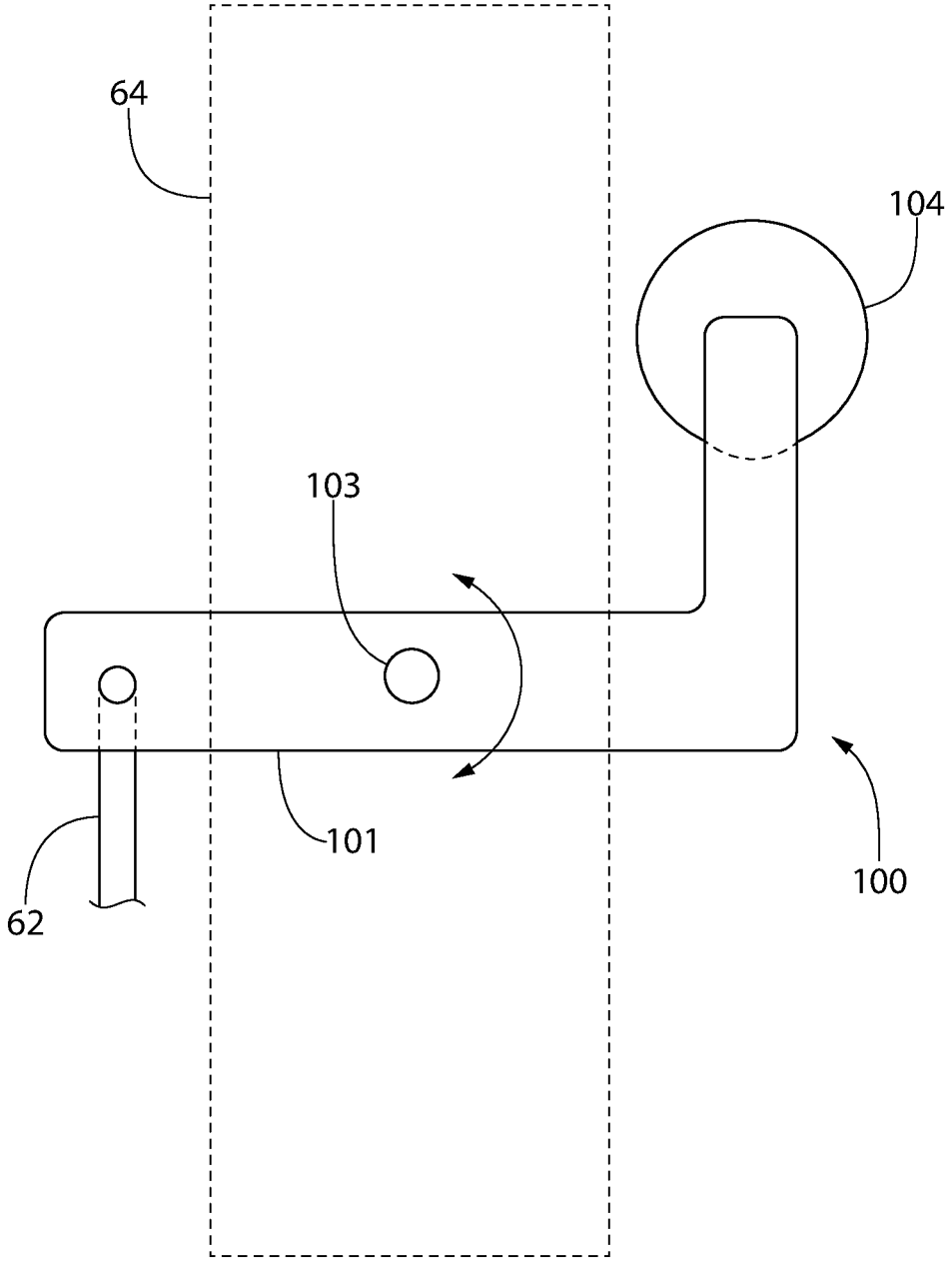
FIG. 13 is a schematic side view of a non-contact magnetic rotational resistance device.
Figure 14:
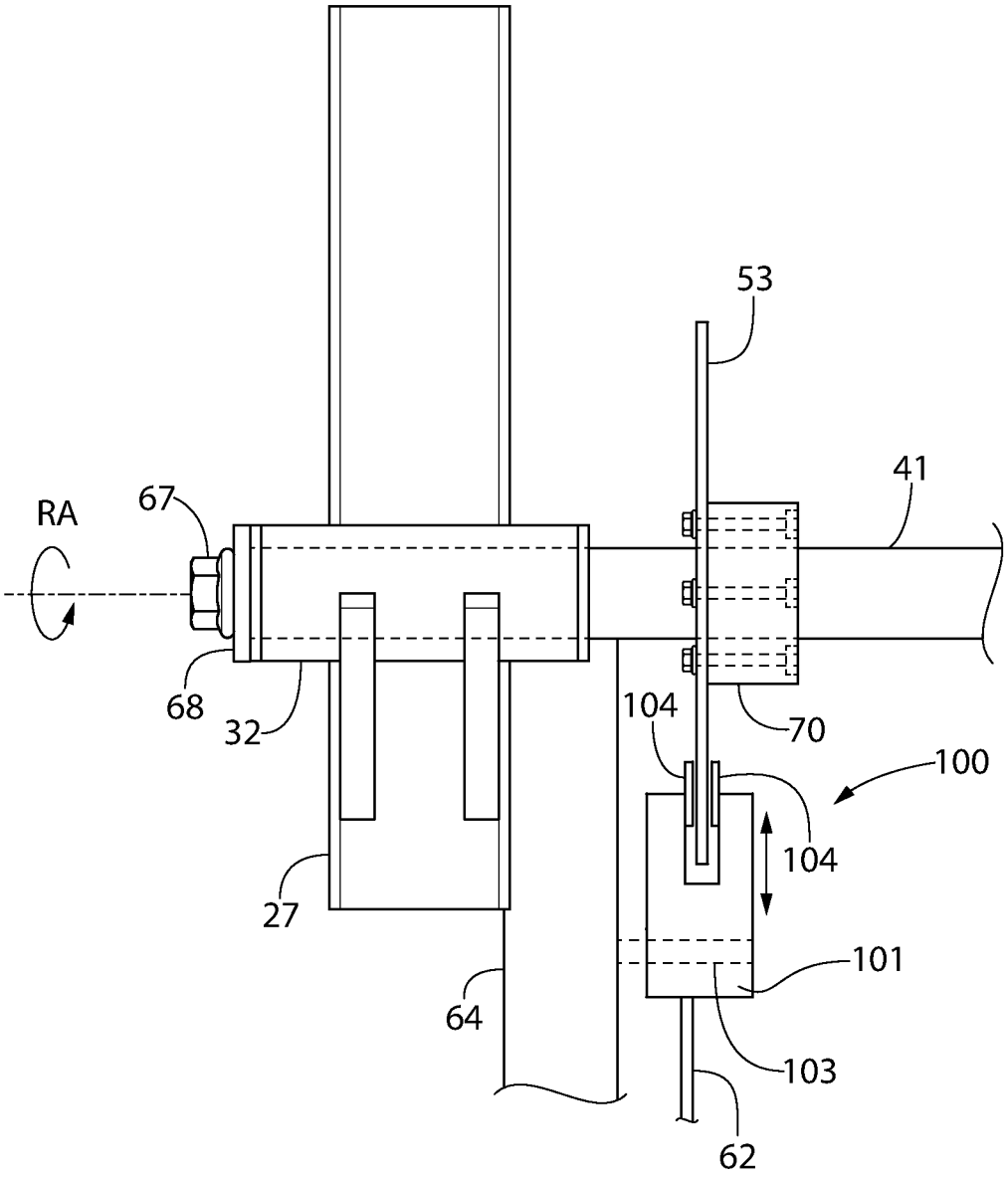
FIG. 14 is a front view thereof mounted on the handle bar rack mounting assembly.

An example of a commercially available drum brake unit 90 that may be used as the frictional resistance mechanism will now be described with reference to FIG. 12. Such units, well known in the art without undue elaboration, generally comprise a flanged hub (not shown on far side) which is fixedly mounted on the rotational support shaft 41 of the handle bar assembly 20 and rotates therewith. An annular brake drum 92 is mounted to the flange hub such as via fasteners (e.g. bolting or screws) using mating holes in the hub and drum to rotate the brake drum with the support shaft 41. The brake assembly 93 is positioned inside the drum and includes arcuately shaped brake shoe and pads 95 coupled to a piston assembly, which moves the brake pads radially outwards to engage the interior surfaces of the arcuately shaped sidewall of the brake drum 92 thereby creating friction. This creates rotational resistance on the rotations support shaft 41 of the handle bar assembly. A control or cam lever 94 is internally coupled to the piston and brake pad assembly which moves the brake pads to increase or decrease frictional resistance between the drum and pad. The control actuator 65 and control cable 62 attached to the cam lever 94 as already described herein may be used to allow the user to increase or decrease the rotational resistance. Such commercially available drum brake units suitable for this application FIGS. 13 and 14 are schematic diagrams showing one example of a non-contact magnetic resistance mechanism 100 that may alternatively be used in lieu of the friction resistance system are common in spinning bikes and well known in the art. Instead of frictional resistance which generates heat and wear, magnetic rotational resistance is non-contact and generated from electro magnetic currents that vary in strength based on the proximity of magnets to the rotor. An adjustment mechanism allows the user to vary the distance between the magnets and the rotor to vary the drag placed on the rotor or rotational resistance. Referring to the foregoing referenced figures, the chassis 21 is similar to the embodiments already described herein except for omission of the specific brackets used to mount the disc brake unit. Rotor 53 is rotationally fixed to the support shaft 41 in the same manner and centered between a pair of magnets 104 which may be fixedly mounted on one end of a pivotally movable U-shaped clevis section of a lever arm 101. The lever arm may be roughly L-shaped and mounted below the rotor 53 in one embodiment. Other mounting positions may be used. One magnet 104 is mounted on each branch of the clevis in opposing relationship. The lever arm 101 may be pivotably mounted by a pivot 103 to a mounting bracket attached to the mounting rack assembly 26. In one embodiment, the mounting support 64 used for the control actuator 65 may be configured and also used for the mounting bracket of the pivot 103; however, a separate bracket may also be used and mounted to the mounting rack assembly 26. The pivot 103 may comprises a pin or fastener (illustrated) which extends through the body of the lever arm 101. In one, the pivot 103 may be located approximately midway between the opposing ends of the lever arm 101 as shown. Other locations for the pivot however may be used.

The adjustment mechanism for the magnetic actuator 100 may comprise the same control cable 62 and actuator 65 previously described herein. The control wire 62 may be attached to the other end of the lever arm 101 opposite the clevis section with the magnets 104. Raising and lowering the control cable 62 via rotating the knob-shaped actuator 65 causes the opposite clevis end of the lever arm 101 with magnets to pivotably move about pivot 103 either towards or away from the rotor, thereby concomitantly increasing or decreasing the rotational resistance force induced by the magnets on the rotor and handle bar assembly 20 respectively. Such magnetic resistance mechanisms are commercially available.

Hydraulic fluid resistance systems that may alternatively be used generally comprise a contained hydraulic fluid in an confined space in conjunction with a rotating impeller therein that provides smooth, steady resistance during rotation of the rotational support shaft 41.

A hydraulic or pneumatic cylinder containing a compressible fluid mounted in conjunction with the rotor may also alternatively be used to create rotational resistance. The cylinder may be rotatably mounted at one end to the mounting rack assembly 26 and the cylinder rod projecting from the other end may be mounted to the rotor 41 and is movable therewith. As the support shaft 41 and rotor 53 fixedly mounted thereto rotates around the rotational axis RA, the cylinder rod extends and retracts in a reciprocating motion in conjunction with rotation of the rotor to which it is mounted. Whether the cylinder is extending or retracting, the linear force imparted to the cylinder rod by the compressible fluid within the cylinder is translated into rotational resistance imparted to the rotor 53.

Although handle bars 40 depicted herein have a single fixed location on each radial arm 46 of the lateral support members 43, in other embodiments the mounting position of the handle bars on the handle bar assembly may be adjustable. As shown in FIG. 7 represented by the dashed circles depicting alternate handle bar mounting positions, each radial arm 46 may have multiple user-selectable handle bar mounting hole 220 locations 220 in which the handle bars 40 may be mounted. Using through holes 220 in the radial arms 46, the handle bars 40 may be tapped on each end with an axial threaded bore and bolted to the radial arms at a desired location thereby allowing users to adjust the position of the handle bars. By adjusting the position of the handle bars 40 inward or outward on the radial arms 46, the radius of rotation and the torsional force change accordingly.

For example, when mounted in holes 220 located closer to the axis of rotation RA, the distance between handle bars becomes closer and users have less of a reach to grasp the next bar. This makes climbing the rotating system less of an effort and accommodates weaker and/or smaller users. When mounted in holes located farther from the axis of rotation, the distance between hand grips becomes larger and users have a greater reach to grasp the next grip. This makes climbing the rotating system more of an effort and accommodates stronger and/or larger users.

It will be appreciated that the handle bar assembly 20 may be mounted at varying heights along the vertical support members 22 in the manner describe herein. This allows different types of exercise routines to be performed and can work numerous different muscle groups. For example, the handle bar assembly may be mounted near the floor and the user may rotate the handle bars with their legs while lying on the back. In another example, the handle bar assembly may be mounted to be reachable at standing height allowing the handle bars to be grasped and rotated while the user is standing on the floor. In yet another example, the handle bar assembly may be mounted above the user's head at a height which requires the user to jump to grab the handle bars. In this case, the user will be completely elevated off the floor while successively gripping one handle bar after another as the handle bar assembly rotates. Accordingly, the invention is limited by the height at which the handle bar assembly is used.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A rotary exercise system comprising:

a chassis configured for detachable mounting between a pair of stationary elongated support members in a plurality of user-selected mounting heights;

an elongated rotational support shaft rotatably supported by the chassis, the support shaft rotatable in opposing directions about an axis of rotation;

a plurality of handle bars coupled to the support shaft and rotatable therewith, the handle bars arranged to encircle the support shaft and be graspable by a user;

a variable resistance mechanism operably coupled to the support shaft, the resistance mechanism configured and operable to apply a selectable rotational resistance on the support shaft which is adjustable by the user;

wherein adjusting the resistance mechanism increases or decreases a physical force required to be exerted manually by a user on the handle bars in order to rotate the support shaft.

2. The exercise system according to claim 1, wherein the resistance mechanism comprises a frictional disc brake assembly operably coupled to the support shaft.

3. The exercise system according to claim 2, wherein the disc brake assembly comprises at least one disc-shaped rotor fixedly coupled to the support shaft and a pair of brake pads frictionally engaged with the rotor, the brake pads moveable towards or away from the rotor to change a frictional force applied to the rotor by the pads.

4. The exercise system according to claim 3, wherein the brake pads are coupled to a caliper which movably supports the brake pads on opposing sides of the rotor, the brake pad axially moveable into and out of engagement with the rotor.

5. The exercise system according to claim 4, further comprising a resistance control assembly operably coupled to the caliper, the resistance control assembly comprising a manually adjustable control actuator having a plurality of operating positions and a control linkage that mechanically couples the actuator to the caliper, wherein changing position of the actuator causes the caliper to increase or decrease pressure applied to the rotor by the brake pads for changing the frictional force on the support shaft.

6. The exercise system according to claim 5, further comprising a cam lever connected to the control linkage and pivotably mounted to the caliper, the cam lever when activated by the control actuator moves the brake pads away or towards the rotor.

7. The exercise system according to claim 1, wherein the handle bars are oriented parallel to the rotational support shaft.

8. The exercise system according to claim 1, wherein the handle bars are attached to a support frame rigidly attached to the support shaft and rotatable therewith.

9. The exercise system according to claim 8, wherein the support frame comprises first and second side support structures fixedly mounted on the support shaft, the handle bars each spanning between the first and second side support structure and attached thereto.

10. The exercise system according to claim 9, wherein each side support structure includes a plurality of radial arms to which the handle bars are attached.

11. The exercise system according to claim 10, wherein the radial arms are configured for mounting the handle bars thereon in a plurality of different distances from the support shaft.

12. The exercise system according to claim 9, wherein the chassis comprises first and second mounting rack assemblies each configured for detachable mounting to one of the elongated support members in a plurality of user-selected mounting heights, the mounting rack assemblies, side support structures, and rotational support shaft being coupled together to collectively form a self-supporting rotary exercise assembly which is transportable as a unit and mountable on the elongated support members.

13. The exercise system according to claim 1, wherein the rotational resistance mechanism is a magnetic resistance mechanism comprising a rotor fixed to the support shaft and centered between a pair of magnets adjustable in position with respect to the rotor, wherein the rotational resistance created by the magnets on the support shaft changes based on the proximity of the magnets to the rotor.

14. The exercise system according to claim 1, wherein the frictional resistance mechanism is a drum brake assembly coupled to the support shaft and operable to apply rotational resistance to support shaft.

15. A rotary exercise system comprising:

a pair of spaced apart vertical support members;

a chassis comprising first and second mounting rack assemblies, each mounting rack assembly configured for detachable mounting to one of the vertical support members in a plurality of positions;

an elongated rotational support shaft rotatably supported by the first and second mounting rack assemblies, the support shaft rotatable in opposing directions about an axis of rotation;

a handle bar assembly comprising a plurality of elongated handle bars extending between a pair of side support structures rigidly coupled to the support shaft for rotation therewith, the handle bars arranged for grasping by a user and circumferentially spaced apart around the support shaft;

a variable frictional resistance mechanism operably coupled to the support shaft, the resistance mechanism configured and operable to apply a selectable rotational resistance on the support shaft which is adjustable by the user;

wherein adjusting the resistance mechanism increases or decreases a physical force required to be exerted manually by a user on the handle bars in order to rotate the support shaft.

16. The exercise system according to claim 15, wherein the frictional resistance mechanism is a disc brake assembly including a rotor coupled to the support shaft for rotation therewith, a caliper comprising axially movable first and second portions each including a brake pad that frictionally engages the rotor, and a user-operated resistance control mechanism operably coupled to the caliper that moves the brake pads towards or away from engagement with the rotor to increase or decrease a frictional force applied to the rotor respectively.

17. The exercise system according to claim 16, wherein the disc brake assembly is mounted to and supported by the first or second mounting rack assembly.

18. The exercise system according to claim 15, wherein the frictional resistance mechanism is a drum brake assembly coupled to the support shaft and operable to apply rotational resistance to the support shaft.

19. The exercise system according to claim 15, wherein the first and second mounting rack assemblies each include mounting holes which are aligned with mounting holes in the vertical support members, and fasteners are inserted through the aligned mounting holes to lock the first and second mounting rack assemblies in position on the vertical support members.

20. The exercise system according to claim 19, wherein the first and second mounting rack assemblies are slideable along the vertical support members and have a plurality of mounting positions to adjust the height of the handle bar assembly from a support surface on which a user stands.

21. A rotary exercise system comprising:

a pair of spaced apart vertical support members;

a chassis comprising first and second mounting rack assemblies, each mounting rack assembly configured for detachable mounting to one of the vertical support members in a plurality of positions;

an elongated rotational support shaft rotatably supported by the first and second mounting rack assemblies, the support shaft rotatable in opposing directions about an axis of rotation;

a handle bar assembly comprising a plurality of elongated handle bars extending between a pair of side support structures rigidly coupled to the support shaft for rotation therewith, the handle bars arranged for grasping by a user and circumferentially spaced apart around the support shaft;

a frictional resistance mechanism supported by the first or second mounting rack assembly and operably coupled to the support shaft, the resistance mechanism configured and operable to apply a selectable rotational resistance on the support shaft which is adjustable by the user;

a user-operated control actuator operably coupled to the frictional resistance mechanism, the control actuator having a plurality of user selectable resistance settings;

wherein adjusting the control actuator to select one of the resistance settings increases or decreases a physical force required to be exerted manually by the user on the handle bars in order to rotate the support shaft.

22. The exercise system according to claim 21, wherein the frictional resistance mechanism is a drum brake or a disc brake assembly.

* * * * *